US009070541B2

(12) United States Patent
Verenchikov et al.

(10) Patent No.: US 9,070,541 B2
(45) Date of Patent: Jun. 30, 2015

(54) MASS SPECTROMETER WITH SOFT IONIZING GLOW DISCHARGE AND CONDITIONER

(75) Inventors: Anatoly N. Verenchikov, St. Petersburg (RU); Anatoly Zamyatin, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 13/817,518

(22) PCT Filed: Aug. 19, 2011

(86) PCT No.: PCT/US2011/048387

§ 371 (c)(1),
(2), (4) Date: Feb. 18, 2013

(87) PCT Pub. No.: WO2012/024570

PCT Pub. Date: Feb. 23, 2012

(65) Prior Publication Data

US 2013/0140453 A1 Jun. 6, 2013

Related U.S. Application Data

(60) Provisional application No. 61/375,095, filed on Aug. 19, 2010.

(51) Int. Cl.
*H01J 49/00* (2006.01)
*H01J 49/10* (2006.01)
(Continued)

(52) U.S. Cl.
CPC ..... *H01J 49/10* (2013.01); *H01J 49/107* (2013.01); *H01J 49/145* (2013.01); *H01J 49/24* (2013.01); *H01J 27/022* (2013.01)

(58) Field of Classification Search
CPC ... H01J 49/00; H01J 49/0027; H01J 49/0045; H01J 49/005; H01J 49/0072; H01J 49/0077; H01J 49/0095; H01J 49/0404; H01J 49/0422; H01J 49/0431; H01J 49/12; H01J 49/168; H01J 49/18
USPC ..... 250/281, 282, 288, 423 R
See application file for complete search history.

(56) References Cited

U.S. PATENT DOCUMENTS 5,889,404 A 3/1999 Abdel-Rahman et al.
6,852,970 B2 2/2005 Yamada et al.
(Continued)

FOREIGN PATENT DOCUMENTS

GB 2406703 A 4/2005
JP 59162447 9/1984
(Continued)

OTHER PUBLICATIONS

International Search Report for PCT/US2011/048387, dated Feb. 28, 2012, six pages.
(Continued)

*Primary Examiner* — Nicole Ippolito
*Assistant Examiner* — Jason McCormack
(74) *Attorney, Agent, or Firm* — Honigman Miller Schwartz and Cohn LLP

(57) ABSTRACT

An ion source (12, 102) for a mass spectrometer comprising an ionizer (18, 106) receiving an ionizer gas from an ionizer gas supply (16), a conditioner (20) in communication with the ionizer (18, 106), a reactor (22, 110) in communication with the conditioner (20) and adapted for communication with the mass spectrometer, the reactor (22, 110) adapted to receive a sample from a sample supply in communication with the reactor (22, 110), wherein the conditioner (20) is sized to remove fast diffusing electrons from a flow of the ionizer gas from the glow discharge ionizer (18, 106) to the reactor (22, 110).

17 Claims, 15 Drawing Sheets

(51) Int. Cl.

| | |
|---|---|
| ***H01J 49/14*** | (2006.01) |
| ***H01J 49/24*** | (2006.01) |
| ***H01J 27/02*** | (2006.01) |

(56) References Cited

U.S. PATENT DOCUMENTS

| | | | | |
|---|---|---|---|---|
| 7,253,406 | B1 | 8/2007 | Sheehan et al. | |
| 2005/0092915 | A1* | 5/2005 | Fukano et al. | 250/288 |
| 2006/0054806 | A1* | 3/2006 | Yamada et al. | 250/288 |
| 2006/0284103 | A1 | 12/2006 | Syage | |
| 2007/0102634 | A1 | 5/2007 | Frey et al. | |
| 2007/0114439 | A1* | 5/2007 | Bajic et al. | 250/426 |
| 2008/0245963 | A1* | 10/2008 | Land et al. | 250/288 |
| 2008/0296493 | A1* | 12/2008 | Willoughby et al. | 250/288 |
| 2009/0152458 | A1 | 6/2009 | Vilkov et al. | |

FOREIGN PATENT DOCUMENTS

| | | | |
|---|---|---|---|
| JP | 2002-56801 | | 2/2002 |
| JP | 2003222612 | A | 8/2003 |
| JP | 2004157057 | A | 6/2004 |
| JP | 2005135897 | A | 5/2005 |
| JP | 2008523554 | A | 7/2008 |
| JP | 2008180659 | A | 8/2008 |
| JP | 2011-133000 | A | 7/2011 |
| WO | WO-2006061625 | A2 | 6/2006 |
| WO | WO-2010012987 | A2 | 2/2010 |

OTHER PUBLICATIONS

Japanese Office Action for related Application No. 2013-524997 dated May 8, 2014.

German Office Action for related Application No. 112011102744.3 dated Dec. 9, 2014.

* cited by examiner

MASS SPECTROMETER WITH SOFT IONIZING GLOW DISCHARGE AND CONDITIONER

BACKGROUND

Gas chromatography paired with mass spectrometry (GC-MS) can be utilized in environmental analysis to extract samples of interest (which can contain impurities within rich chemical matrices) from media, such as food, soil or water. In an example, samples are separated in time utilizing gas chromatography (GC) and injected into an ionization source for compound ionization and identification using a mass spectrometric (MS) analysis.

Some GC-MS processes employ an electron ionization (EI) ion source to ionize the samples or compounds using an electron bombardment process to thereby produce a fragment spectra. Compounds are identified by comparing the generated spectra with a library of standard EI spectra. This technique can be used to identify up to one hundred compounds per run within a dynamic range of between low picograms (pg) to tens of nanograms (ng).

Two-dimensional gas chromatography (GCxGC) can broaden the identification to thousands of analyzed compounds per run but the EI spectra may not provide sufficient molecular peak statistics for a wide range of particularly fragile and volatile analytes. This can affect and contaminate proper identification.

In general, relatively softer ionization methods, such as chemical ionization (CI) and field ionization (FI), may be used to provide desired molecular peak information. CI may employ ion molecular reactions of a proton transfer and is highly selective (e.g., this provides strong suppression and interference for compounds with low proton affinity.) The CI source, however, can be poorly compatible with fast gas chromatography separation and is incompatible with two-dimensional gas chromatography having 10-20 ms peaks. FI is fairly universal but can be complicated, unstable, and insensitive with a typical detection limit of 100 pg (i.e., two orders lower compared to electron ionization.)

Photo ionization (PI) is another soft ionization method that has been used in connection with moderately polar compounds. In one instance, sealed UV lamps are used to ionize a GC eluent and ion current is thereafter measured, or ion compounds are identified using optical spectroscopy. It has been suggested to implement PI at atmospheric conditions for GC-MS analysis. In an example, PI is additionally accompanied by a damping of internal energy at atmospheric pressure, as such can make it softer as compared to vacuum UV ionization. Dopant vapors of acetone or benzene may be added to reinforce efficiency. Confusion in spectra interpretation can result, however, due to the resultant generation of ions, such as $M^+$ ions, $MH^+$ ions, ionic clusters and fragment ions. Moreover, there is a much higher spread of compound dependent ionization efficiency in PI compared to EI.

Glow discharge (GD) ionization methods have also been used. Direction ionization with glow discharge at 1-10 mbar gas pressure has been employed, but organic compounds exhibit significant fragmentation comparable to the fragmentation that occurs using an EI source thereby limiting the detection limit to about 1 picogram. Even when gas pressures are increased notable fragmentation is still observed. Separation of GD and reaction regions at atmospheric gas pressure diminishes efficiency and results in non-uniform ionization across a wide range of compounds, such as polar and non-polar organic compounds.

In short, analytical measurements of generic GC-MS are unsatisfactory and there remains a need for improved ionization methods that result in uniform efficiency of ionization across a wide range of polar and non-polar compounds.

SUMMARY

In general, the invention relates to a spectrometer source for producing and a method of using a soft ionizing glow discharge (GD). Specifically, a spectrometer source includes a conditioner that softens the ionizing glow discharge to ensure a substantially uniform efficiency of ionization for a wide range of polar and non-polar analytes while minimizing the amount of fragmentation of the analyte. This conditioner and conditioning method provides a tool to facilitate analysis of complex and fragile samples of analytes. Additionally, analytes can be analyzed with the soft ionizing GD source along with other ionization sources, such as electron impact (EI) ionization and photoionization (PI) sources.

Advantageously, the spectrometer source for producing and a method of using a soft ionizing GD improves the ability to detect complex and fragile analytes relative to other ionization methods with uniform ionization at high sensitivity, e.g., about 0.1 picograms of analyte.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
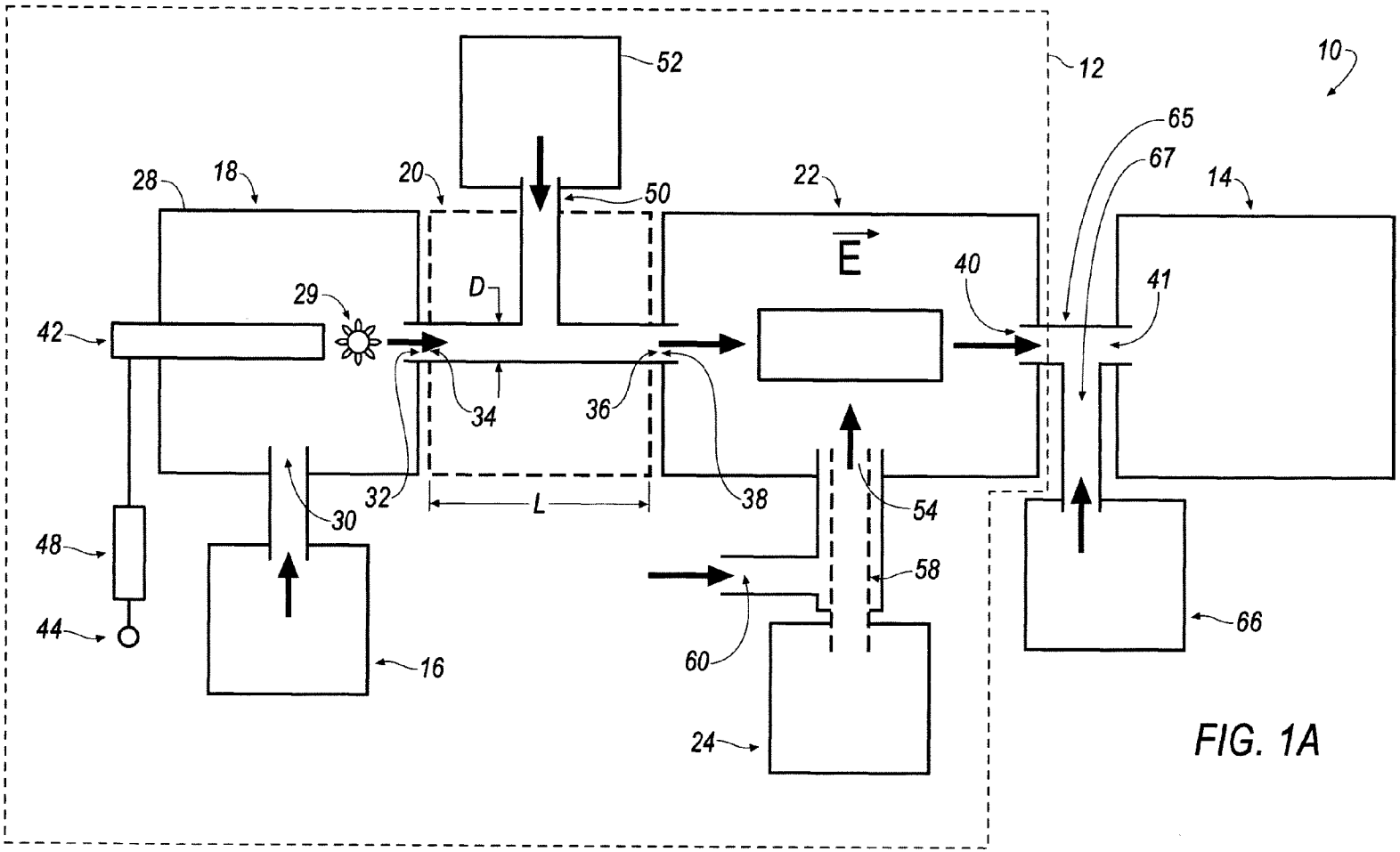
FIG. 1A provides a schematic view of an exemplary mass spectrometer system having a soft glow discharge ionization source.

Referring to FIG. 1A, in some implementations, a mass spectrometer system 10 includes an ion source 12 in communication with an ion detector 14. Ion source 12 may include a first gas supply 16 in communication with a first ionizer 18. In an implementation, first ionizer 18 may be a glow discharge ionizer and first gas supply 16 may supply noble gases, including Helium, Argon, Neon, Nitrogen and Oxygen, among others, to provide a substantially selective and soft ionization. It is to be appreciated that non-noble gases may be used and the invention should not be limited to noble gases.

In an implementation, ion source 12 includes a conditioner 20 connecting first ionizer 18 to a reactor 22. Among other things, conditioner 20 may be provided to discourage contamination of first ionizer 18 from stream contaminants that can introduce undesirable fragments and add unwanted noise within the system. Examples of contaminants include organic contaminants, highly excited metastable atoms, e.g., Rydberg excited atoms and electrons. Reactor 22 is in communication with a sample gas supply 24 and ion detector 14.

With continued reference to FIG. 1A, first ionizer 18 may comprise a glow discharge ionizer having a chamber 28 that defines a glow discharge region 29, a chamber fluid input 30 and a chamber fluid output 32. Conditioner 20 includes a conditioner fluid input 34 and a conditioner fluid output 36, reactor includes a reactor fluid input 38 and reactor fluid output 40 and ion detector 14 includes an ion detector fluid input 41. As depicted, conditioner fluid input 34 is connected to chamber fluid output 32, conditioner fluid output 36 is connected to reactor fluid input 38 and reactor fluid output 40 is connection to ion detector fluid input 41. Unless otherwise stated, the terms connector and communicate shall imply a fluid connection or fluid communication. In addition, it is to be appreciated that such connection or communication may be direct or indirect such that a conduit or other means may be used to facilitate the connection or communication. These and other features will become apparent to one of ordinary skill in the art when considering this disclosure.

In an implementation, an electric field (including those produced by RF or DC) is applied within glow discharge region 29 of chamber 28 to direct positive ions into conditioner fluid input 34 for sampling, while counter-urging electrons to move away from conditioner fluid input 34.

In an implementation, an electrode 42 is at least partially disposed within chamber 28 to provide the electric field. Electrode 42 may be electrically connected to a power source 44 (such as a voltage source) whereby a resistor 48 (such as a ballast resistor) is provided therebetween. In an implementation, power source 44 produces a positive voltage across electrode 42 to attract the electrons and eschew positive ions away from electrode 40 and toward conditioner fluid input 34. It is to be appreciated that various arrangements can be used to activate electrode 42 or generate an electric field and the invention should not be limited to the described exemplary arrangements.

In an example, power source 44 provides current of about 1 mA to electrode 42 as conditioner 20 samples dense plasma and gas comprised of ions, electrons and metastable atoms and molecules. Electrode 42 is disposed between about 1 mm and about 2 mm away from conditioner fluid input 34. Resistor 48 is a 1 mOhm ballast resistor and power source 44 is a voltage source that provides between about 0.5 kV and about 1.5 kV. The foregoing arrangement passes a current between about 0.1 mA and about 1 mA to electrode 42 to provide a stable glow discharge from electrode 42. It may be appreciated that power source 44 may be used to stably and linearly control the current through electrode 42.

In an implementation, conditioner 20 defines a channel or tube and may be sized to remove fast diffusing electrons (e.g., Rydberg excited metastable neutral atoms) while still allowing the transfer of hundreds of nA of positive Helium ions between chamber fluid output 32 and reactor fluid input 38. As depicted in FIG. 1 and in an implementation, conditioner 20 is a tube having a length L and an inner diameter D. For example, and among other possibilities, length L and diameter D of the tube of conditioner 20, and therefore the length of gas flux through it, may be chosen to provide a transfer time of between about 5 ms and about 10 ms, as is sufficient to remove fast diffusing electrons. In an implementation, conditioner 20 may remove plasma that allows field free conditions in reactor 22.

In some implementations, conditioner 20 is a conductive tube. Generally, tube ionic transmission losses disappear or substantially disappear for tubes having an inner diameter D and gas pressure P between about (50-100) mm*mbar. Accordingly, in some implementations, conditioner 20 is configured as a tube (e.g., a stainless steel tube) having a length L of about 15 mm and an inner diameter D of about 2 mm. Efficient ion transfer can occur when the gas pressure in the glow discharge ionizer 18 is at least about 30 mbar. In some implementations, one or both of the connecting channels (e.g., ionizer 18, conditioner 20, reactor 22 and the conduits therebetween) and gas flow from gas supply 16 are configured to sustain a gas pressure of between about (30-300) mbar, and in some examples between about (50-100) mbar. Moreover, in some examples, a product of the inner diameter D of conditioner 20 and a pressure of glow discharge ionizer 18 is at least 50 mm*mbar.

With continued reference to FIG. 1A, conditioner 20 may include a dopant input 50 in communication with a dopant source 52. Dopant source 52 may be provided to introduce doping agents to ions generated in glow discharge region 29, such as positive Helium ions, that pass through conditioner 20. In an implementation, the doping agents are provided in a manner that facilitates downstream mixing within conditioner 20. Doping agents may be doping vapors, including those associating benzene, acetone, or the like.

In an implementation, doping agents are provided to cause a charge transfer between the positive Helium ions and the dopant form one or more $M^+$ dopant ions. The resultant $M^+$ dopant ions may thereafter be used to transfer a charge onto analyte molecules, which are then subsequently measured by ion detection including mass spectrometric techniques. Various doping agents may be introduced to conditioner 20 and can be selected based upon a variety of reasons and desired characteristics. It is to be appreciated that the selection of such doping agents may be based on the desired outcome, and one factor that may be considered in such a selection is the tradeoff between uniform ionization and ionization to isolate a particular class or particular classes of compounds. For instance, the dopant can be selected such that the resulting the ion potential in eV is less than Helium (about 24.6 eV) but greater than organic analytes, which typically have a ion potential of between 7 and 12 eV. In some circumstances, the dopant may be selected such that the dopant ion potential is less than some organic analyte ion potential but greater than others. For instance, the dopant may be selected to have a dopant ion potential of 10 eV so that only certain classes of analytes, i.e., those with a ion potential less than 10 eV would form analyte ions and be subsequently detected.

In an implementation, reactor 22 may include a sample gas input 54 in communication with sample gas supply 24, in which sample gas supply 24 supplies a sample gas flow containing a reagent to reactor 22 via a conduit 58 or other means.

In an implementation, gas supply 24 may employ gas chromatography to supply the relevant volatile sample to reactor 22. As may be desired, conduit 58 may additionally include a carrier gas input 60 to allow a carrier or sample gas to carry or move analytes from sample gas supply 24 to reactor 22. In an alternate arrangement, carrier gas input 60 may be directly provided on reactor 22 to directly introduce carrier gas into reactor 22.

As an example, Argon may be used as a carrier gas and delivered into carrier gas input 60. Argon can accelerate the delivery of analyte from sample gas supply 24 into reactor 22. Moreover, the carrier gas (e.g., Argon) can improve the transfer of analyte ions from reactor 22 to ion detector 14.

In various implementations, conduit 58 may be a capillary column, may be heated and may be washed by an additional gas to accelerate transfer characteristics.

As the analyte moves within reactor 22, it becomes mixed with the gas flow from ionizer 18 and a charge transfer reaction thereafter occurs within reactor 22.

An exemplary reaction is represented below:

$$R^+ + A \rightarrow R + A^+ \quad (1)$$

The foregoing reaction is exothermic as the ionization potential of Helium ions $He^+$ (24.5874 eV) is much larger than that of $A^+$ (7-12 eV). Accordingly, gas collisions may rapidly dampen and produced excessive energy. As described above, dopant ions $D^+$, which can be formed by collisions with $He^+$, can also be used to generate analyte ions $A^+$. Whether or not analyte ions are formed depends upon the ion potential of the dopant ion versus the ion potential of the analyte.

In some implementations, a sampling channel 65 (e.g., a tube) connects reactor fluid output 40 to fluid input 41 of ion detector 14.

In an implementation, the pressure in reactor 22 may be maintained slightly lower than the pressure in the glow discharge ionizer 18. Among other methods, such pressure may be controlled by the sizes and arrangements of the inner walls of the conditioner 20 and sampling channel 65.

In an implementation, sampling channel 65 may further define a damping gas input 67 for insertion of damping gas within sampling channel 65 and in fluid communication with ion detector 14 and reactor 22.

It is to be appreciated that rapid damping of internal energy can occur at gas pressures of between about 1/20 and about 1/10 of atmospheric pressure and although molecular ions may appear dominant in organic spectra, some fragmentation can occur. Due to the large difference in ionization potentials of He and A, the charge exchange reaction rate depends little on analyte chemistry, and thus provides uniform ionization efficiency for a wide range of organic classes.

In an implementation, to facilitate fast chromatographic separation, reactor 22 is heated to at least 200° C. and, in some examples, between about 250° C. and about 300° C. For the same reason, among other reasons, a residence time of the gas flow(s) in reactor 22 may be maintained to between about 30 ms and about 100 ms in case of GC-MS analysis, and between about 5 ms and about 30 ms in case of (GCxGC)-MS analysis. Among other methods, residence time may be controlled by the size of sampling channel 65 and/or an internal volume of reactor 22. In some implementations, sampling channel 65 is a tube having a diameter of about 0.5 mm size and reactor 22 defines a chamber having a volume of about 200 $mm^3$. This arrangement provides a residence time in reactor 22 of about 4 ms, thereby providing substantial compatibility with fast (GCxGC) separation techniques and provides increased sensitivity when compared to larger size reactors or higher gas pressures.

It is to be appreciated that, based on the current disclosure, charge transfer reactions may occur at field free conditions within reactor 22 and ion detector 14 may sample the reaction products by flowing gas from reactor 22, into sampling channel 47 and then into ion detector 14.

In various implementations, ion detector 14 may include a mass spectrometer, a tandem mass spectrometer, a mobility spectrometer, or a tandem of mobility spectrometer and mass spectrometer. In some implementations, ion detector 14 includes a current collector, which may be equipped with a mass cut-off filter, such as a radio-frequency quadrupole at an intermediate gas pressure.

Figure 2:
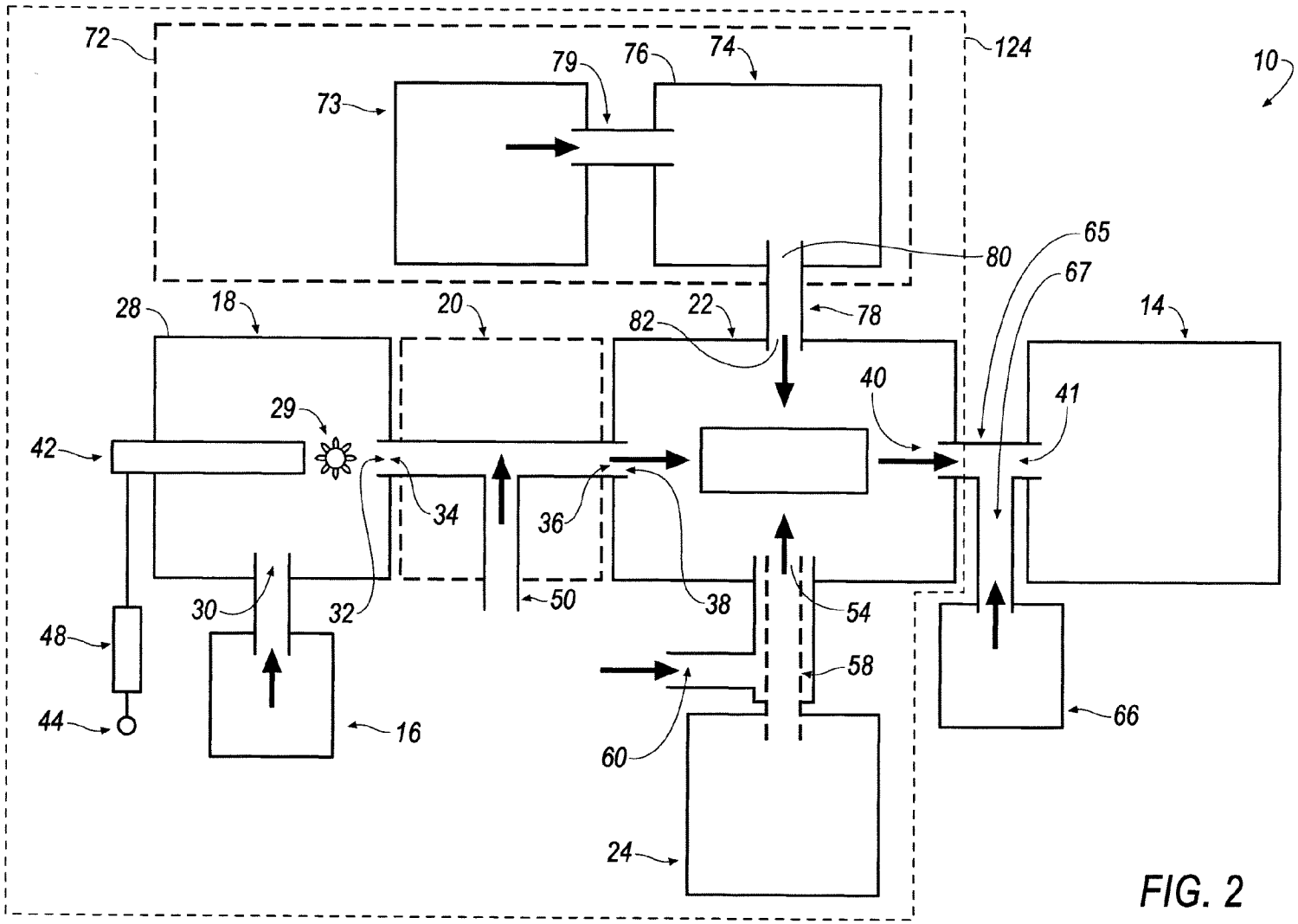
FIG. 2 provides a schematic view of an exemplary mass spectrometer system employing multiple ionizers.

In some implementations, and as exemplarily shown in FIG. 2, reactor 22 may be provided in connection with multiple ionizers and such multiple ionizers may be fully decoupled from reactor 22 via altering characteristics of sampling channel 65. Moreover, a switching device may be employed to switch between individual ionizers. Among other ways, switching between ionizers can be accomplished by one or more of the following: controlling electric fields within each ion source, controlling photon flux to one or more ionizers and by switching between communication lines.

Since the mass spectrum of an analyte differs due to the difference in the ionization sources (e.g., different charge exchange reactions occur between the analyte and ions generated from the various sources of ionization), the differences in the mass spectra recorded of the same analyte with various ionization sources can be used to identify the analyte.

It is to be appreciated, based on this disclosure, that mass spectrometers operate at relatively lower gas pressures than ion source 18. Accordingly, when ion detectors are used in mass spectrometer systems 10, the mass spectrometer system 10 may include one or both of a differential pump and an ion transfer system between ion source 12 and ion detector 14. In some implementations, the ion transfer system may include gaseous radio frequency (RF) focusing or guiding devices.

For example, and with reference now to FIGS. 1 and 2, to focus ions utilizing RF devices, a damping gas supply 66 may be provided. Damping gas input 67 is arranged in communication with damping gas supply 66 to facilitate the introduction of damping gas into the sample as sample passes through sampling channel 65.

In an implementation, damping gas may be a relatively heavier gas than one or both of the sample and/or the ion transfer system (not shown). For example, a mixture of approximately 5-10% of Argon into a sample containing Helium enhances transmission of ions within RF ion guides across a wide range of ion masses. In an implementation, argon may be added to the Helium by one or a combination of conduit 58, damping gas input 67 and directly into reactor 22 and RF ion guide. Moreover, the ion guide(s) can be maintained at a pressure of between about 100 Pa and about 1000 Pa.

Figure 1B:
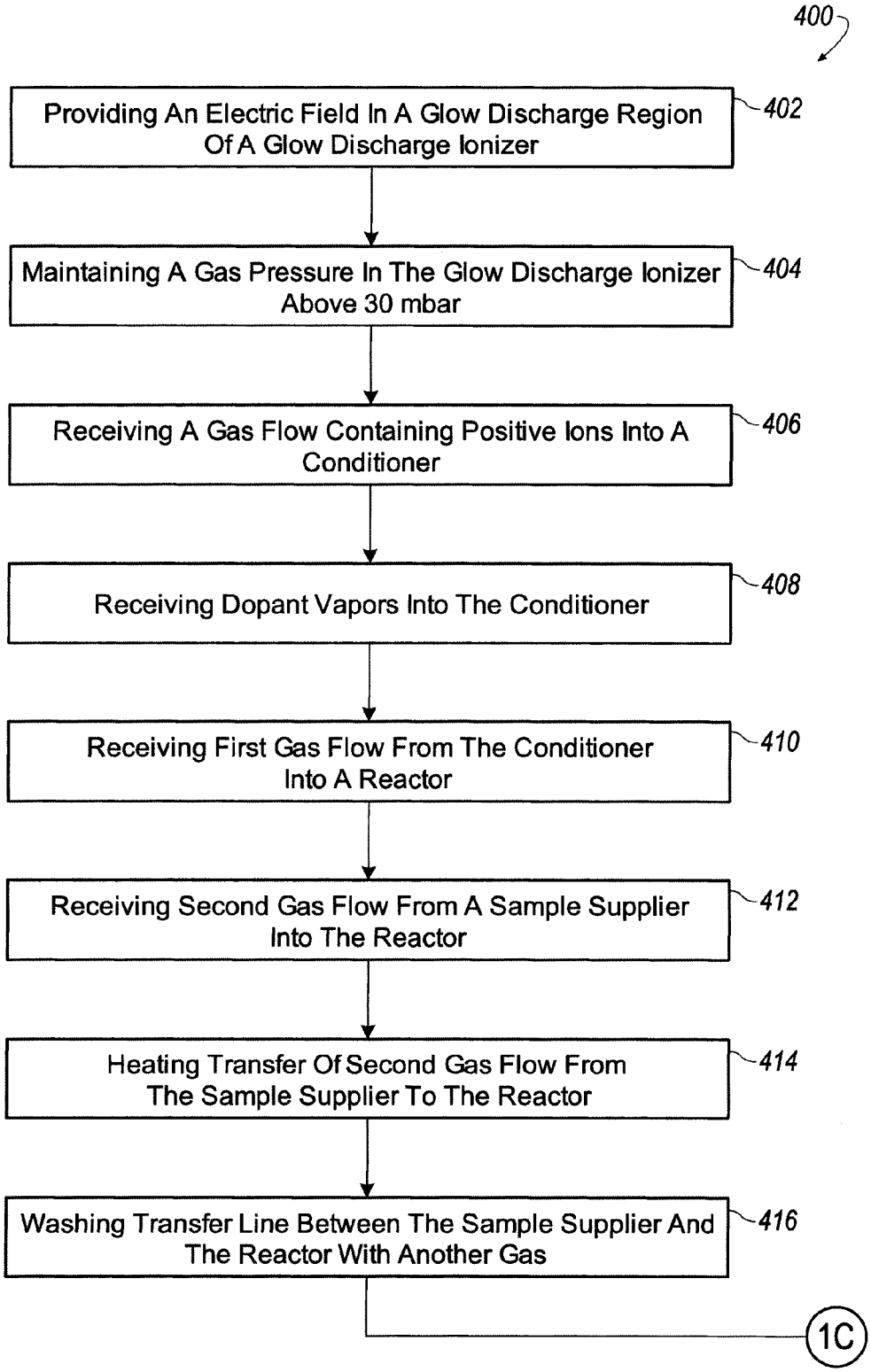
FIGS. 1B and 1C provide an exemplary arrangement of operations for operating a mass spectrometer system.
Figure 1C:
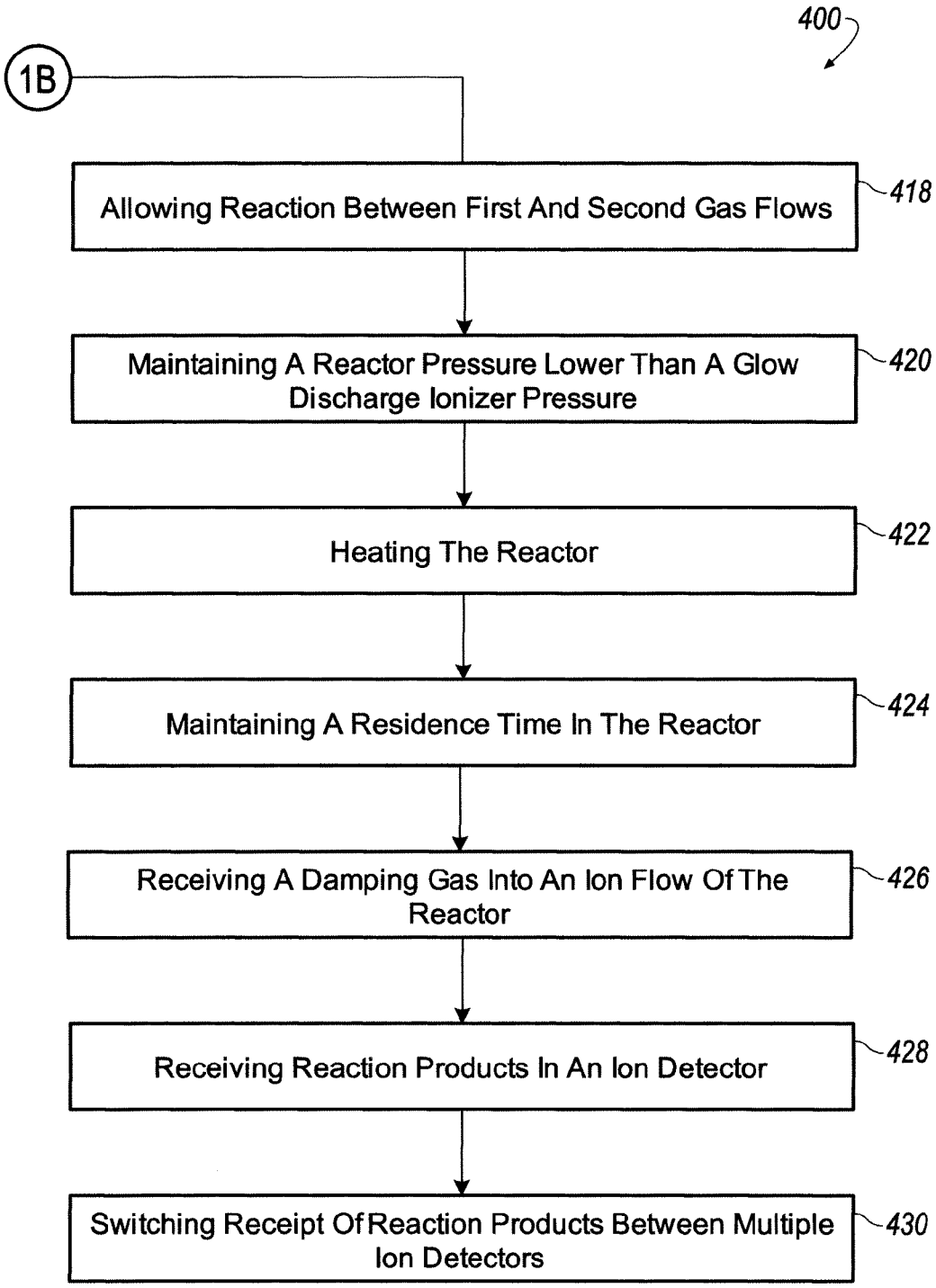

FIGS. 1B and 1C provide an exemplary arrangement 400 of operations for operating mass spectrometer system 10. Operations include providing an electric field in glow discharge region 29 within chamber 28 of glow discharge ionizer 18 by applying a positive voltage to electrode 42. The operations may include maintaining 404 a gas pressure within chamber 28 of glow discharge ionizer 18 above 30 mbar. In some implementations, the gas pressure within chamber 28 of glow discharge ionizer 18 may be maintained between about 30 mbar and about 300 mbar, and, in some examples, between about 50 mbar and about 100 mbar. The operations further include receiving 406 a flow of gas containing positive ions into conditioner 20 for sampling. In some examples, the operations include receiving 408 doping agents into conditioner 20 from dopant source 52 for interaction with the gas flow. The operations further include receiving 410 a first gas flow from conditioner 20 into reactor 22 and receiving 412 a second gas flow from sample gas supply 56 into reactor 22 via sample gas input 54. In some examples, the operations include heating 414 conduit 58 that delivers the gas flow from the sample gas supply 56 to reactor 22. In additional examples, the operations include washing 416 conduit 58 with an additional gas to accelerate sample transfer into and through reactor 22. The operations further include allowing 418 a reaction between the first and second gas flows.

The operations may further include maintaining 420 a pressure in reactor 22 that is lower than a pressure in chamber 28 of ionizer 18. To sustain fast chromatographic separation, the operations may further include heating 422 reactor 22 to at least 200° C. and, in some examples, between about 250° C. and about 300° C. Moreover, the operations may include maintaining 424 a residence time of the gas flow(s) in reactor 22 to between about 30 ms and about 100 ms in case of GC-MS analysis, and between about 5 ms and about 30 ms in case of (GCxGC)-MS analysis. The operations, in some implementations, include receiving 426 a damping gas into an ion flow of reactor 22 (e.g., directly into reactor 22, via sampling channel 65, and/or an ion transfer system (not shown) connected to sampling channel 65). The operations further include receiving 428 reaction products in ion detector 14. In some examples, the operations include switching 430 receipt of reaction products between multiple ion detectors as discussed above.

Referring now to FIG. 2 and as discussed above, in some implementations, a second ionizer 72 may be provided in addition to first ionizer 18, to form a dynamic ion source 12A in communication with ion detector 14. Ion source 12A includes a second gas supply 73 that supplies a flow of gas to a second ionizer 74 having a chamber 76 via a gas transfer conduit 79. Each of first ionizer 18 and second ionizer 74 are placed in communication with and are common to reactor 22. In the example shown, a transfer conduit 78 connects a second ionizer output 80 with a secondary reactor ion input 82 of reactor 22.

As depicted, first ionizer 18 is a glow discharge ionizer and second ionizer 74 may be an alternative type of ionizer, such as a photo ionizer or corona discharge ionizer. Respective gas flows from the first gas supply 16 and second gas supply 73 (whichever is turned on) control the delivery of reagent ions from the respective ionizers 18, 74 to reactor 22. The injected reagent ions mix with analyte molecules and induce charge exchange reactions with analyte. Ion detector 14 samples product ions via sampling channel 65. Among other methods, second ionizer 74 may be controllably switched on and off by switching corresponding voltages and by pneumatically controlling gas flows supplied by one or both of first gas supply 16 and second gas supply 73. These and other controlling features will become apparent to one of ordinary skill after considering the full breadth of this disclosure.

In an implementation, second ionizer 74 is a photo ionizer and may employ a sealed ultraviolet (UV) lamp. A selectivity of the ionization may be adjusted by using multiple UV ionizers or multiple UV lamps within second ionizer 74. Second gas supply 73 may deliver a noble gas or a highly dry alternative gas, such as $N_2$, to extract reagent ions from second ionizer 74. In some examples, doping agents (including, without limitations, acetone, benzene and the like) are mixed with the second gas flow to enhance ionization efficiency. According to an implementation, the gas pressure within second ionizer 74 may be maintained between about 100 mbar and about 300 mbar, and a partial pressure of dopant agent can be maintained between about 1 mbar and about 30 mbar. The gas pressure within second ionizer 74 can be set higher than within first ionizer 18 when using a relatively higher impedance within gas transfer line 79.

In an implementation, the type of reagent ions exhibited from second ionizer 74 may be selectively controlled by one or both of the type of UV lamp and the type of doping agent used within second ionizer 74, among other things. For example, for most common Xe and Ar UV sealed lamps, an acetone dopant may promote formation of $AH^+$ ions in reactor 22, while a benzene dopant may promote formation of $A^+$ ions in reactor 22.

In some examples, using a photo ionizer as second ionizer 74 in combination with a benzene doping agent generates $A^+$ analyte ions only, except for nitrogen containing compounds with high proton affinity, wherein $AH^+$ ions can be formed by self-induced protonation. This is drastically different from the properties of a photo ionization (PI) source in LC-MS, as described in Damon B. R., Covey T. R., Bruins A. P., Atmospheric pressure photo-ionization: An ionization method for liquid chromatography-mass spectrometry, *Anal. Chem.,* 72 (2000) 3653-3659. In the case of LC-MS, the inevitable addition of a solvent complicates the ion molecular chemistry and leads to the formation of multiple types of ions, including molecular, quasi-molecular and molecular-cluster ions.

In additional examples, second ionizer 74 may be provided as a corona discharge ionizer APCI and formatted at sub atmospheric gas pressure. Introducing doping agents including a compound with a moderate proton affinity such as acetone to the APCI ionizer provides protonated reagent ions. Although such a configuration would cause high selectivity of the analysis, second ionizer 74 is able to provide extremely soft ionization by a protonation mechanism with no visible traces of fragmentation.

Ion source 12A may be used a generic ionization tool for wide range of ion detectors. In some examples, ion source 12A can be used as a chromatographic detector based on collector current measurements. If ion source 12A includes an RF device for filtering carrier gas ions and reagent ions, a background signal may remain at a level of between about 1 pg/sec and about 10 pg/sec (e.g. a low pA current). Thus, picogram samples may be detected. Using selectivity properties of first ionizer 18 and second ionizer 74, one can reduce the chemical noise further and detect even smaller quantities of the sample.

The selectivity of ion detector 14 can be improved by using a mobility spectrometer. As will be appreciated, ion source 12A naturally fits the mobility spectrometer operating at mbar gas pressure range, while being pumped by a single mechanical pump. Such a mobility spectrometer preferably employs ion accumulation in an ion trap for pulsed ion release.

In some examples, mass spectrometric detectors or tandem mass spectrometric detectors provide enhanced sensitivity. Referring to FIG. 2, deploying a photo ionizer as ionizer 74 and an orthogonal accelerating TOF, allows a detection limit for most poly-aromatics, chlorinated and nitrogen containing compounds that remains under 0.1 pg. Moreover, the analytical properties may strongly depend on the properties of the employed materials and on the amount of out-gassing from those materials. Relatively better results may be achieved by avoiding the use plastic and rubber materials in ion source 12, 12A and by sealing the ionizers 18, 74 and the reactor 22. In an implementation, reactor 22 may be substantially free of electric fields for avoiding acceleration of residual free electrons.

Figure 3A:
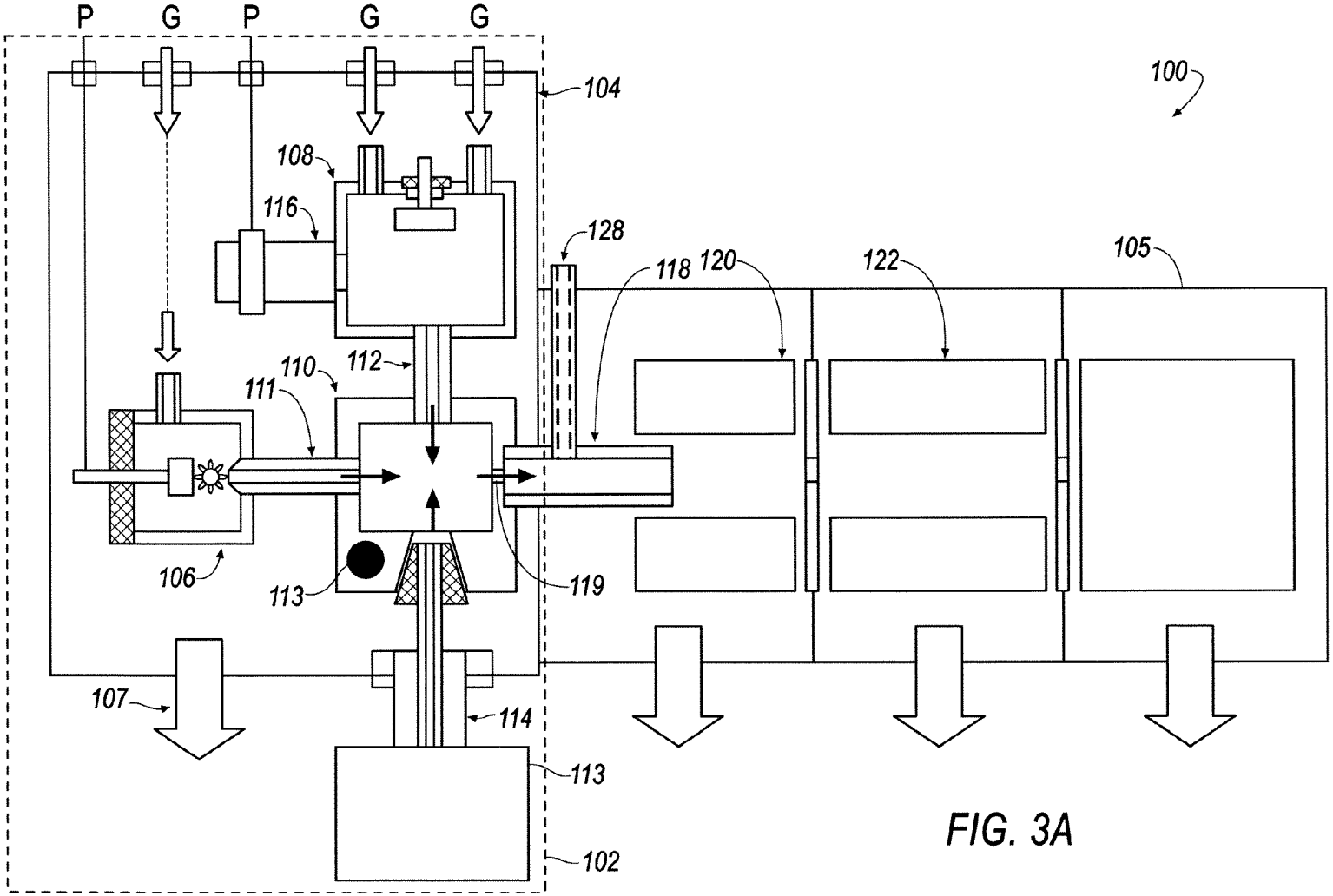
FIG. 3A provides a schematic view of an exemplary mass spectrometer system.

Referring now to FIG. 3A, an exemplary mass spectrometer system 100 is shown. System 100 includes an ion source 102 communicably attached to a mass spectrometer 105.

Ion source 102 includes a source housing 104 connected to an evacuator 107. In an implementation, evacuator 107 is an evacuation pump and will be referred to as such throughout the remainder of this disclosure. In an implementation, source housing 104 includes first and second ionizers 106, 108 connected to a reactor 110 via first and second conduits 111, 112 respectively. A heater 113, such as a cartridge heater, is disposed within reactor 110.

First and second ionizers 106, 108 receive desired gases G and power P from external supplies, as depicted. Similarly, reactor 110 is connected to an external gas supply 113, such as, for example, a chromatograph that supplies analyte vapors to reactor 110 via a transfer line 114. In an implementation, the external gas and power sources each include delivery conduits that sealingly extend through a wall of housing 104 and engage the relevant structure as exemplarily depicted by the arrows and lines in FIG. 3A. In an implementation, one or more seals are provided to provide the sealing extension through the wall of housing 104. In an implementation, one or more of the seals are a ceramic conical seal. For example, a ceramic conical seal may be provided to connect evacuation pump 107 to source housing 104. In an implementation, all components that are in communication with reactor 110 and ionizers 106, 108 are made of vacuum clean materials, like metal, glass and ceramics and are free of plastics, elastomers and the like.

In an implementation, first ionizer 106 is a glow discharge ionizer as previously disclosed and second ionizer 108 is a photo-ionizer. For ease of disclosure, second ionizer 108 will be referenced as a photo-ionizer, but the invention should not be so limited to the employment of a photo-ionizer as the second ionizer. As depicted, photo-detector 108 includes a sealed UV lamp 116.

In an implementation, reactor 110 provides a sampling channel 118 to connect reactor 110 with one or both of a first RF ion guide 120 and a second RF ion guide 122.

In an exemplary operation, evacuation pump 107 is activated to create a vacuum within housing 104 to yield a fore-vacuum gas pressure therewithin of about 1 mbar, which is lower than the gas pressure within first and second ionizers 106, 108 and in reactor 110.

Heater 113 elevates the temperature within reactor 110 to at least 150° C. and, in some examples, between about 150° C. and about 300° C. to prevent analyte absorption on the internal walls of reactor 110, and to preserve chromatographic separation. In some implementations, the internal walls of reactor 110 are coated with an inert material, such as nickel or a nickel alloy. Reactor 110 may be the hottest part of ion source 102. First and second conduits 111, 112, disposed between reactor 110 and first and second ionizers 106, 108 may be made of stainless steel to resist heat transfer, and may provide at least a 100° C. temperature drop between reactor 110 and first and second ionizers 106, 108. As ions are transferred by gas flows, the potentials of first and second ionizers 106, 108 and of reactor 110 are substantially equivalent. This allows metal chromatographic seals with metal or carbon ferules to be utilized between the components disposed within ion source 102. In addition, the chambers within first and second ionizers 106, 108 can be made of metal and/or ceramic parts which may be sealed by surface-to-surface seals without using elastomers (which may suffer out-gassing). Any leaks appearing in the seals can be pumped out of the housing 104 by evacuation pump 107, which can sustain a pressure gradient and prevent penetration of fumes into the analytical portion of the ion source 101, i.e., inside the ionizers 106, 108 and the reactor 110.

Housing 104 may remain cold due to convection of the externally surrounding air. Thus, the power and gas supply lines and seals may employ elastomers. Moreover, small out-gassing of those elastomers would not get into the analytical portion of ion source 102 (i.e., inside first and second ionizers 106, 108 and reactor 110 because of relatively small gas pressure within the envelope. As a result, ion source 102 with the surrounding source housing 104 at the fore-vacuum gas pressure provides a solution for using clean materials, while strongly suppressing material out-gassing within the analytical area of ion source 102.

Figure 3B:
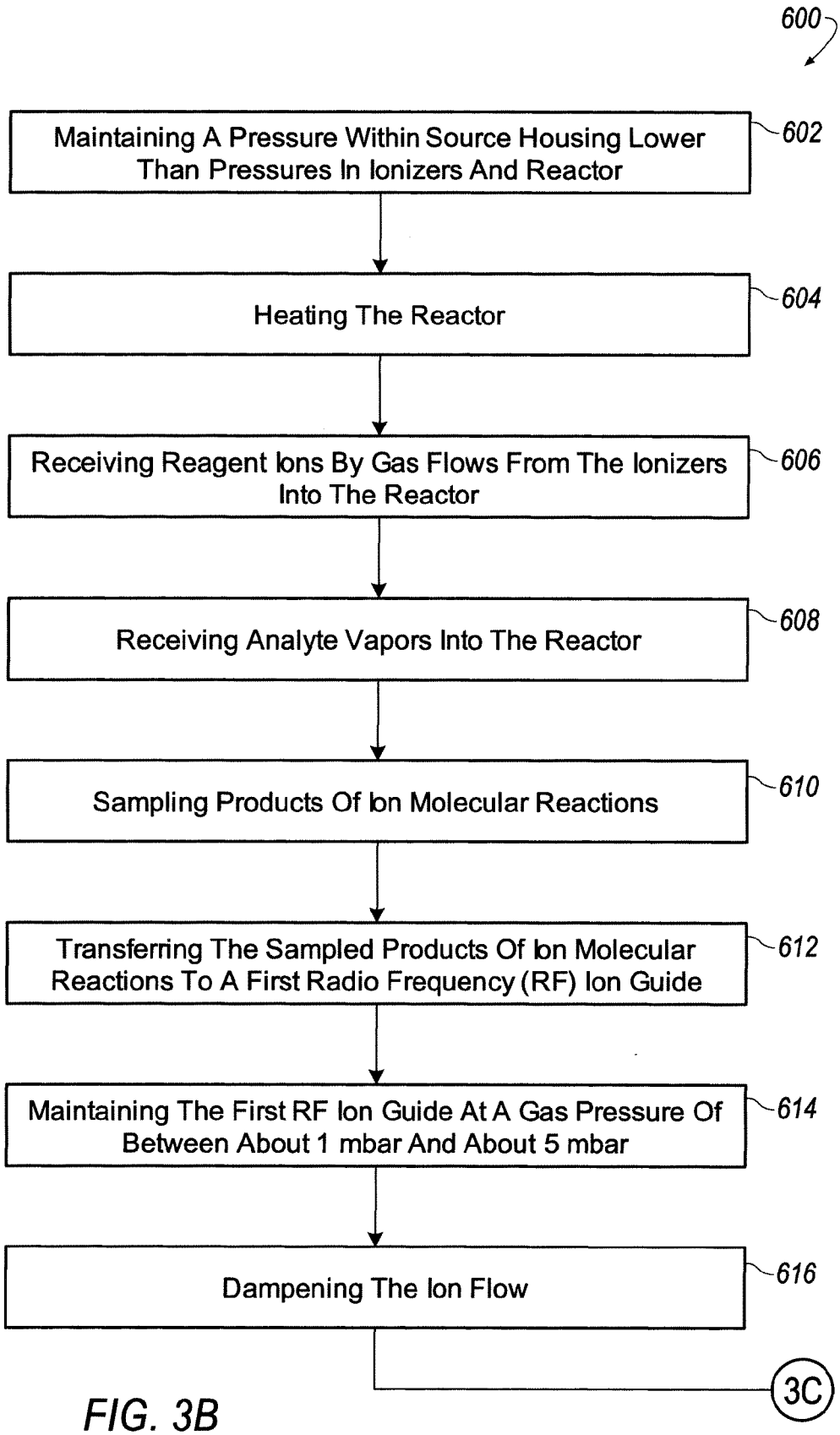
FIGS. 3B and 3C provide exemplary arrangements of operations for operating a mass spectrometer system.
Figure 3C:
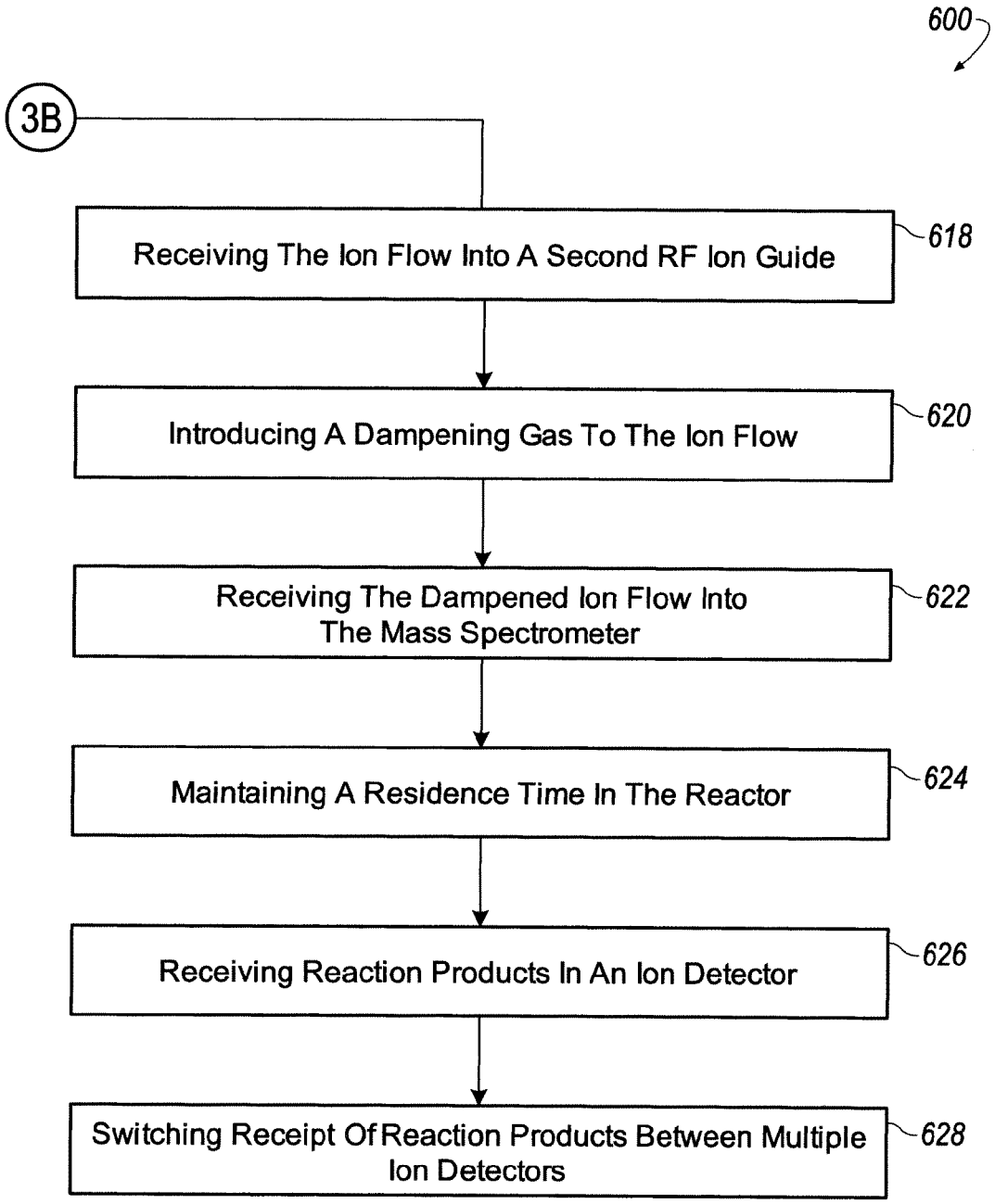

FIG. 3B provides an exemplary arrangement 600 of operations for operating the mass spectrometer system 100 to transfer ions from ion source 102 into mass spectrometer 104. The operations include maintaining 602 a pressure in source housing 104 (e.g., about 1 mbar) lower than pressures in first and second ionizers 106, 108 and in the reactor 110, and heating 604 reactor 110 (e.g., with the heater 113) to at least 200° C. and, in some examples, between about 250° C. and about 300° C. The operations include receiving 606 reagent ions by gas flows from the ionizers 106, 108 into reactor 110 and receiving 608 analyte vapors from gas supply 113 via transfer line 114 into reactor 110. The reagent ions transfer charge onto the analyte molecules. The operations include sampling 610 products of the ion molecular reactions through a restricting aperture 119 located between reactor 100 and sampling tube 118 and transferring 612 the sampled products of ion molecular reactions through the ion sampling tube 118 to first RF ion guide 120. The gas flow and gas pressures may be arranged for efficient ion transfer through the ion sampling tube 118 and also to form a well directed gas jet past the ion sampling tube 118. The operations may include maintaining 614 the first RF ion guide 120 (e.g., an RF quadrupole ion guide) at a gas pressure of between about 1 mbar and about 5 mbar. The operations also include dampening 616 the ion flow. The ion flow is well dampened to penetrate through the differential pumping aperture past the first RF ion guide 120. The operations include receiving 618 the ion flow into the second RF ion guide 122, which may be brought (e.g., by a pump, such as a turbo pump) to a gas pressure of between about (100-1000) Pa.

In examples where the carrier gas is Helium and the gas supplied to first and second ionizers 106, 108 is Helium, there may be deficient collisional dampening of the ions within the RF ion guides 120, 122. To improve the dampening, the operation may include introducing 620 a dampening gas, such as a heavier and relatively clean gas (e.g., argon), via a supply line 128 either into the ion sampling tube 118 or directly into the housing of the first RF ion guide 120. An addition of approximately 10% of Argon flow as compared to the total Helium flow can improve the dampening to make transfer efficiency equalized over a useful mass span. The operations further include receiving 622 the dampened ion flow into the mass spectrometer 105.

Figure 4:
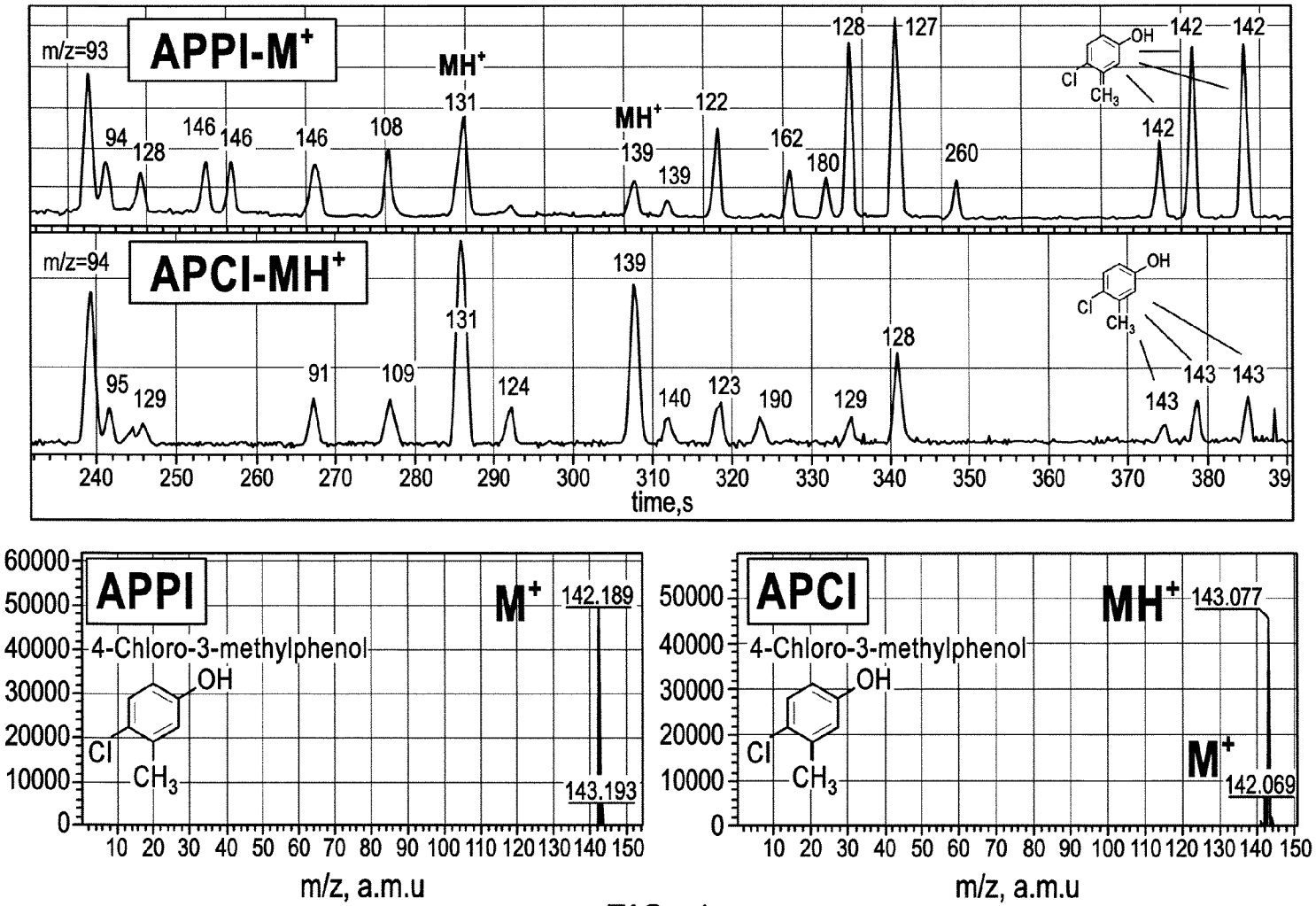
FIG. 4 provides a graphical representation of exemplary data showing aligned chromatograms and typical mass spectra for APPI and APCI ionization methods.
Figure 5:
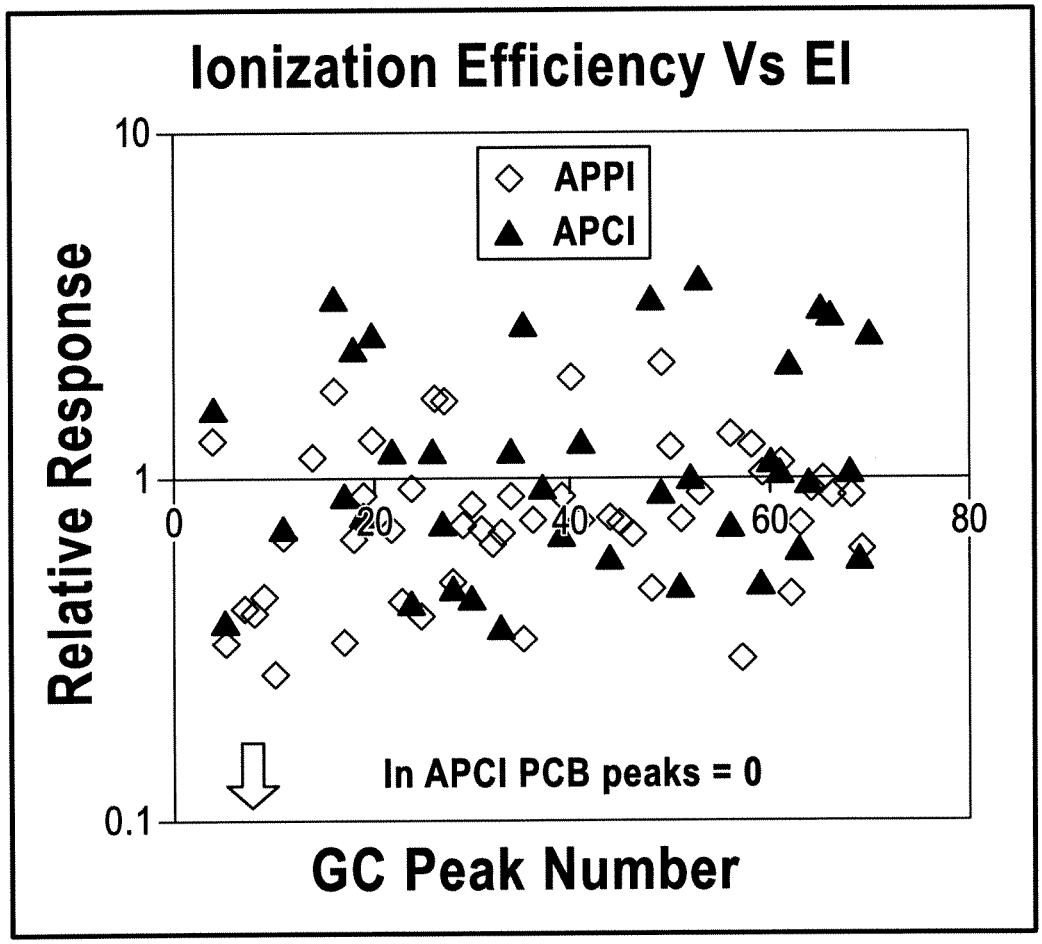
FIG. 5 provides a graphical representation of exemplary data showing relative ionization efficiency in APPI and APCI methods compared to a uniform ionizing Electron Impact (EI) ionization on a sample.
Figure 6:
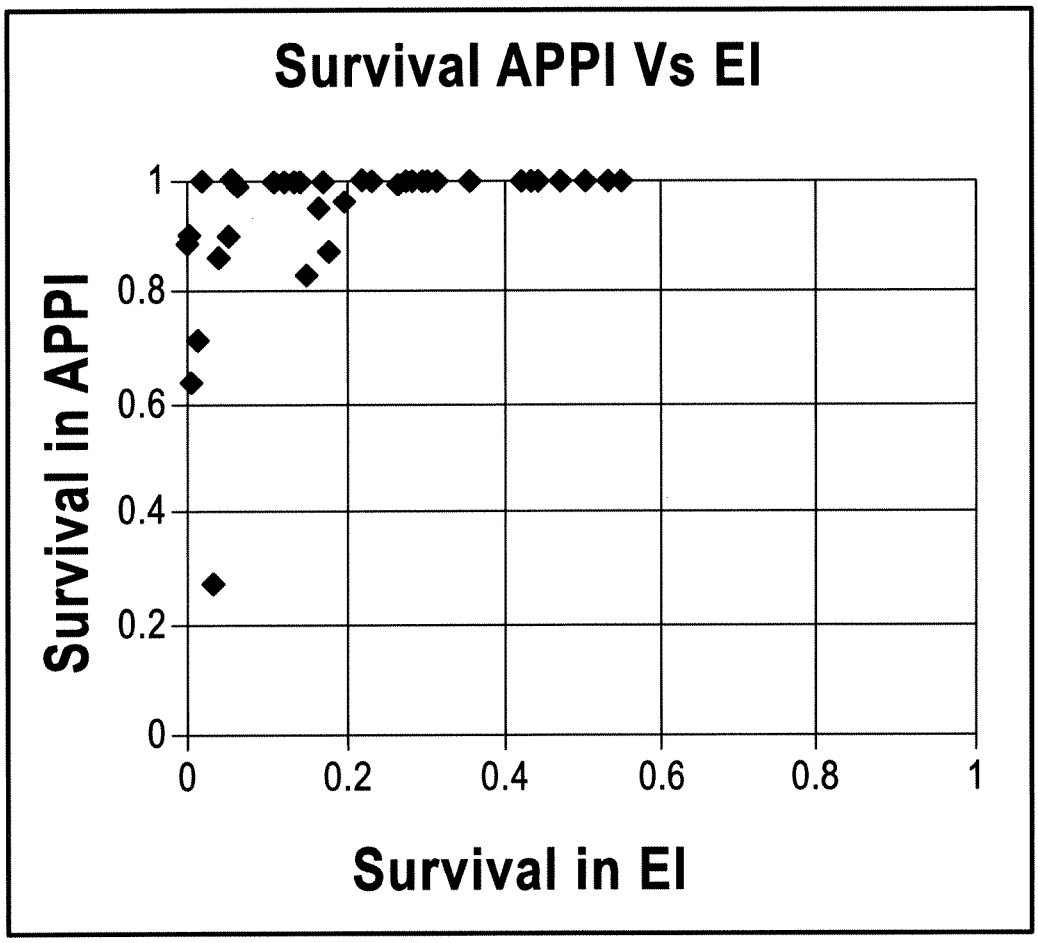
FIG. 6 provides a graphical representation of exemplary data showing molecular ion survival in an APPI method versus molecular ion survival in an EI method.

FIGS. 4-6 illustrate experimental results of a mass spectrometer system 100 throughout various modes, such as atmospheric pressure chemical ionization (APCI), which is an ionization method that may be used in mass spectrometry, and is a form of chemical ionization which takes place at atmospheric pressure and photo-ionization (PI) modes (e.g., harsh and soft glow discharge, and photo and corona discharge ionization).

For the experiments, mass spectrometer 110 comprised an orthogonally accelerating time-of-flight mass spectrometer with an average resolving power of 5000. Moreover, various arrangements with single and dual RF ion guides 120, 122 were tested as well. The dual RF ion guide arrangement provides higher sensitivity though at a cost of increased gas consumption.

For the PI mode, photo-ionizer 108 employs a sealed and RF induced Xenon PID lamp. The gas pressure in the photo-ionizer 108 is varied from 10 mbar to 1 atm. A benzene dopant is added at 1-10 mbar partial gas pressure. The gas pressure is maintained between 100 mbar and 300 mbar. The arrangement with the external reactor (versus direct lamp mounting on the reactor 110) provides better sensitivity (likely due to higher efficiency of dopant ionization) and cleaner spectra with mostly $A^+$ ions. Corona discharge on a sharp needle at microampere current range induces APCI ionization. The gas pressure in the ion source 102 can be maintained between about 100 mbar and about 300 mbar. An acetone dopant is added at 1-10 mbar partial gas pressure.

FIG. 4 provides a graphical representation of exemplary experimental results which show aligned segments of total ion chromatograms (TIC) for PI and APCI modes of ionization at GC-MS analysis of a MegaMix-78 sample (available from Restek Co. of 110 Benner Circle, Bellefonte, Pa. 16823) including 78 components, primarily poly-aromatic hydrocarbons (PAH), poly-chlorinated benzenes (PCB), nitrogen and oxygen containing compounds and phthalates. Peak labels on TIC traces correspond to m/z of molecular ions. Since APPI produces mostly $M^+$ ions and APCI produces mostly $MH^+$, for a majority of peaks, m/z differs by 1. FIG. 4 also shows a difference in spectra on the example of one component 4-chloro-3-methylphenol. While APPI provides mostly $M^+$ ions, the APCI provides mostly $MH^+$ ions.

With reference to TIC traces, APCI TIC contains fewer peaks with a relatively stronger spread of intensities, which is caused by selectivity of the proton transfer reaction. Thus, for the purpose of uniform ionization, the charge transfer reaction in APPI is a more desirable mechanism ionization than proton transfer in APCI.

FIG. 5 provides a graphical comparison of relative efficiency of ionization for APPI and APCI ionization modes versus ionization efficiency in electron impact (EI), which is a method with low spread in ionization efficiency. Though the presented portion of observed peaks demonstrate 10-fold spread in both APPI and APCI, a number of components were not observed in APCI mode or provided peaks by 2-3 orders of magnitude lower. This again illustrates the selectivity of APCI method. Such selectivity may be desired when analyzing polar targets and the selectivity helps reduce chemical noise and signal of matrix. However, the selectivity can be an obstacle for use as a generic analytical method for a wide range of polar and non polar compounds.

FIG. 6 provides a graphical comparison of the survival of molecular ions (i.e., the percentage of the molecular ion intensity per the entire spectrum content) between the APPI and EI ionization methods on the exemplary MegaMix sample. The graph demonstrates that the APPI method is much softer compared to the EI method. The APPI method exhibits no fragmentation for compounds having survival in the EI method between 0.2 and 0.6. For the most fragile compounds in the mixture, such as phthalates, their survival in the APPI method varies from 0.2 to 0.6, while EI spectra has negligible intensity of molecular ions.

For APPI ionization, the experimental results provided no correlation between fragmentation degree and ionization potential. The fragmentation is primarily governed by stability of the molecule (i.e., correlates with fragmentation degree in the EI mode). The survival of compounds has little variation in the wide range of gas pressure from few mbar to atmospheric gas pressure. Indeed, APPI spectra are softer than vacuum PI spectra, but tens of mbar gas pressure is already sufficient for collisional dampening of internal energy of small organics. Furthermore, an expected sharp cut off in ionization efficiency for compounds with ionization potential above the photon energy was not observed. For example, while using a Xenon lamp with 10.2 and 10.6 eV bands and a benzene dopant with 9.24 eV ionization potential, a signal of propane with 10.94 eV ionization potential was observed. Those observations indicate that charge transfer in the photo ionization method with the presence of dopant molecules includes formation of ion clusters, wherein ionization potential of the clusters is lower compared to one of bare molecules. Although APCI and APPI ionization methods are sensitive (0.01-0.1 pg detection limit) and soft, these methods offer selectivity and a large spread in ionization efficiency. This becomes particularly apparent at an attempt of ionizing non polar saturated hydrocarbons (SHC) or highly chlorinated compounds.

FIGS. 7-11 provide graphical illustrations of experimental results using the mass spectrometer system 100 in a glow discharge mode. Direct ionization in glow discharge and ionization by soft glow discharge, i.e., ionization by conditioned ions generated by glow discharge were compared. In both cases, ionization efficiency appeared very similar to that in the EI method, but the soft GD method provided a much stronger molecular ion and a lesser degree of fragmentation. Unlike the direct GD method, the soft GD method provided very reproducible spectra content that was very insensitive to ion source parameters.

Figure 7:
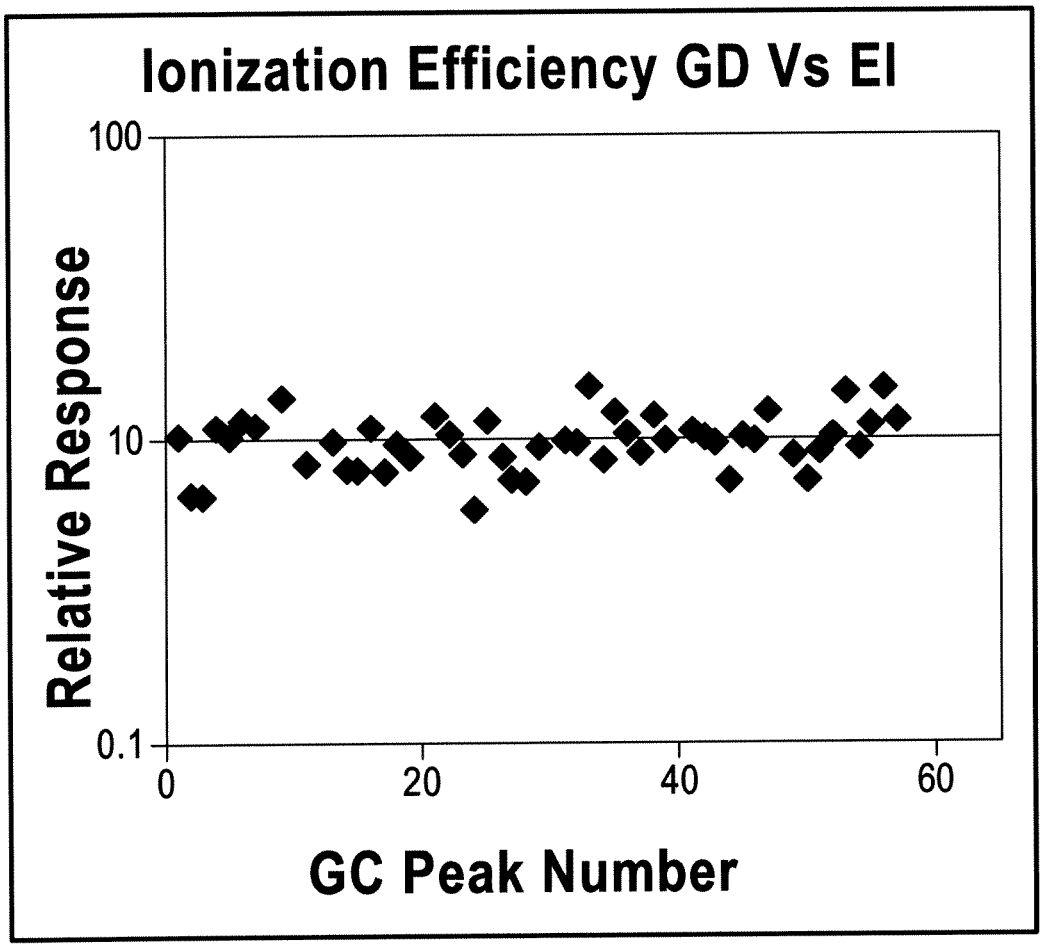
FIG. 7 provides a graphical representation of exemplary data showing relative ionization efficiency in a soft glow discharge method.

FIG. 7 illustrates a comparison between ionization efficiency of the soft GD method to ionization efficiency of the EI method on the exemplary MegaMix-78 sample. With variations within a factor of 2, the soft GD method provided uniform efficiency of ionization and was superior to the APPI method and the APCI method.

Figure 8:
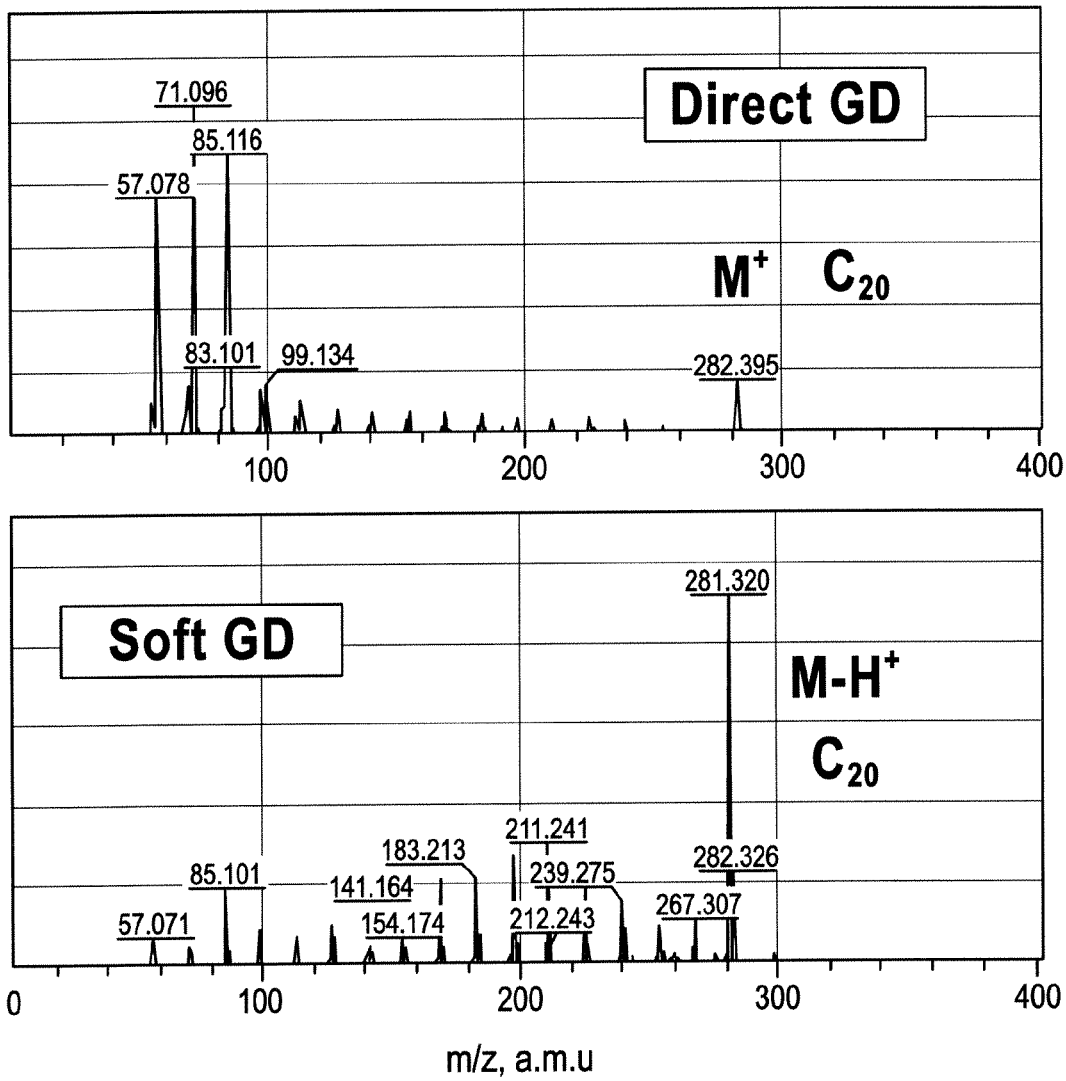
FIG. 8 provides a graphical representation of exemplary data showing a comparison of spectra for a harsh glow discharge source with direct analyte injection and a soft glow discharge source with ion conditioning prior to reactions with analyte molecules.

FIG. 8 presents spectra of saturated hydrocarbons (SHC) for $C_{20}H_{42}$ for both modes of the GD methods—direct GD and soft GD with ion conditioning. The soft method provides dominating molecular peaks $(M-H)^+$ and moderate intensity fragments corresponding to $(CH_2)_n$ loss, while the harsh GD method generates much stronger fragmentation.

Figure 9:
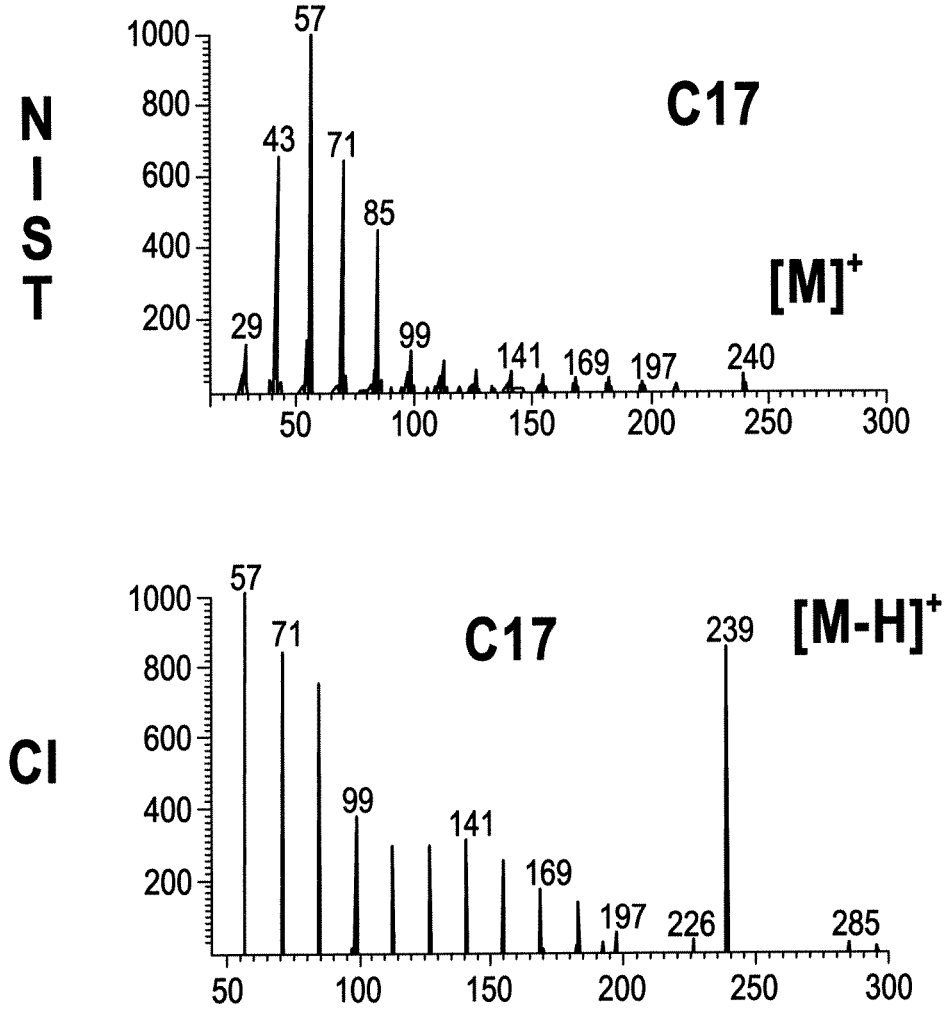
FIG. 9 provides a graphical representation of exemplary data showing a comparison of literature spectra for an electron impact method (presented as NIST standard EI spectra) and a method of chemical ionization for heptadecane-saturated hydrocarbon.

FIG. 9 illustrates a comparison between literature spectra for heptadecane (SHC $C_{17}$) for an Electron Impact (EI, here presented by NIST spectrum) ionization method and for a Chemical Ionization (CI) method within the EI source. The EI spectrum has almost negligible intensity of $M^+$ peak. Due to a similar $CH_2$ fragment pattern and weak molecular peaks, the EI spectra could be confused between heavy hydrocarbons. Chromatographic time provides limited help, because it may be shifted for branched chains. Chemical ionization (CI) notably improves identification of heavy SHC, since it provides molecular peak information. The presented CI spectrum of heptadecane contains $(M-H)^+$ peaks and $(M-H-C_nH_{2n})^+$ fragments and the intensity of quasi-molecular ion is much stronger than in the EI method.

Referring back to FIG. 8, the soft GD method provides even stronger molecular peak than the CI method. Contrary to the CI method, the molecular peak is dominant in a soft GD spectrum. At the same time, the soft GD spectrum contains the same set of fragments which may be used for confirmation of the structure. Moreover, excellent reproducibility of the soft GD spectra allows collection of standard spectra for future identifications.

Figure 10:
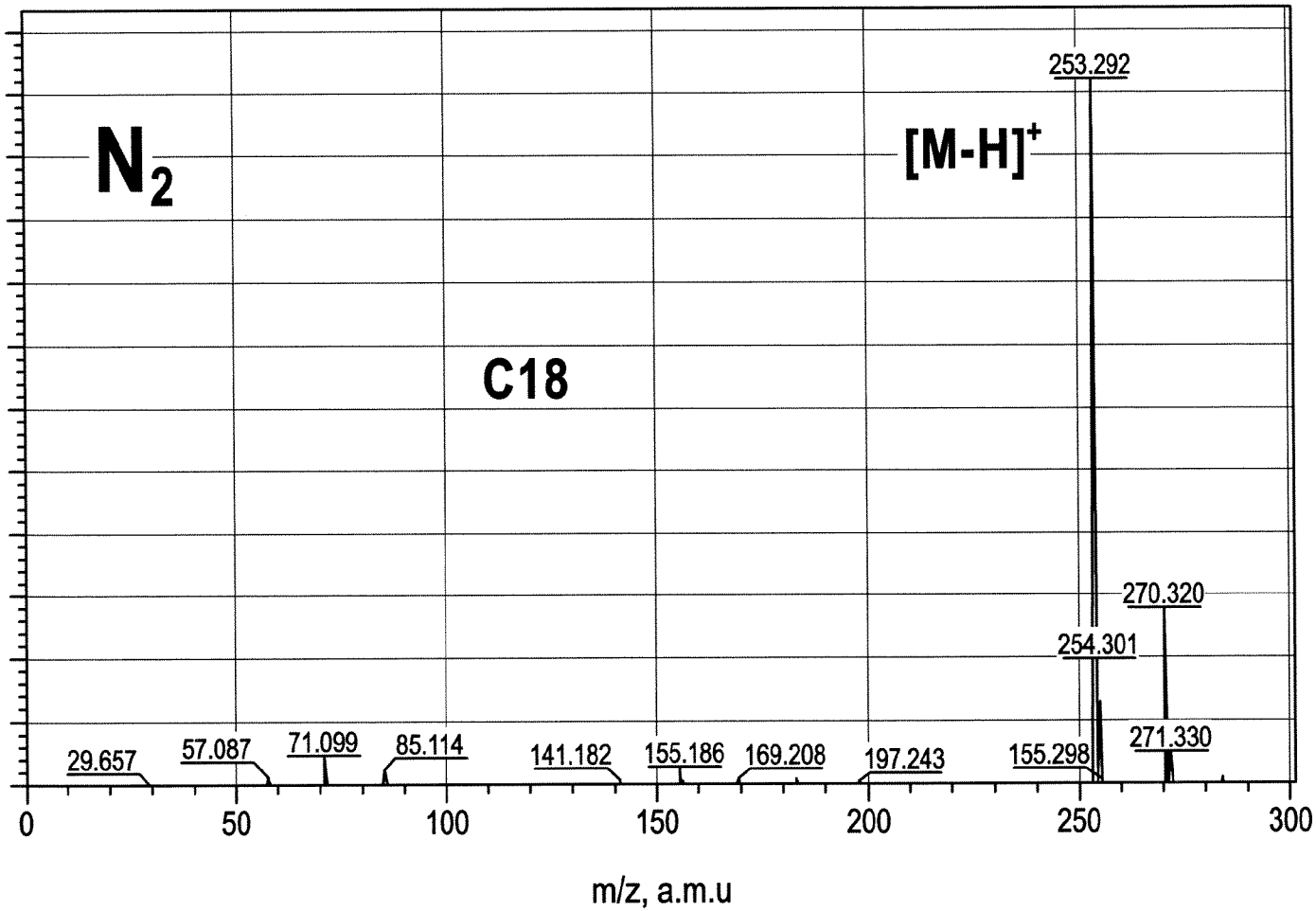
FIG. 10 provides a graphical representation of exemplary data showing a spectrum obtained in a soft glow discharge method using Nitrogen as a discharge gas.

FIG. 10 illustrates a comparison of spectra for octadecane (SHC $C_{18}$) for soft GD discharge in Helium and in Nitrogen. The soft GD method in nitrogen provides much softer ionization, although moderately complicated by formation of cluster ion $(M+NH_2)^+$. This may be bypassed by using high resolution mass spectrometry, such as multi-reflecting time-of-flight mass spectrometry, which provides differentiating mass shifts and indicates the presence of a nitrogen atom in the cluster. Thus, switching gases in the soft GD method (e.g., switching operating gases) provides control of the softness of ionization. The same or similar control may be obtained by adding dopant vapors downstream of the GD ionizer.

Figure 11:
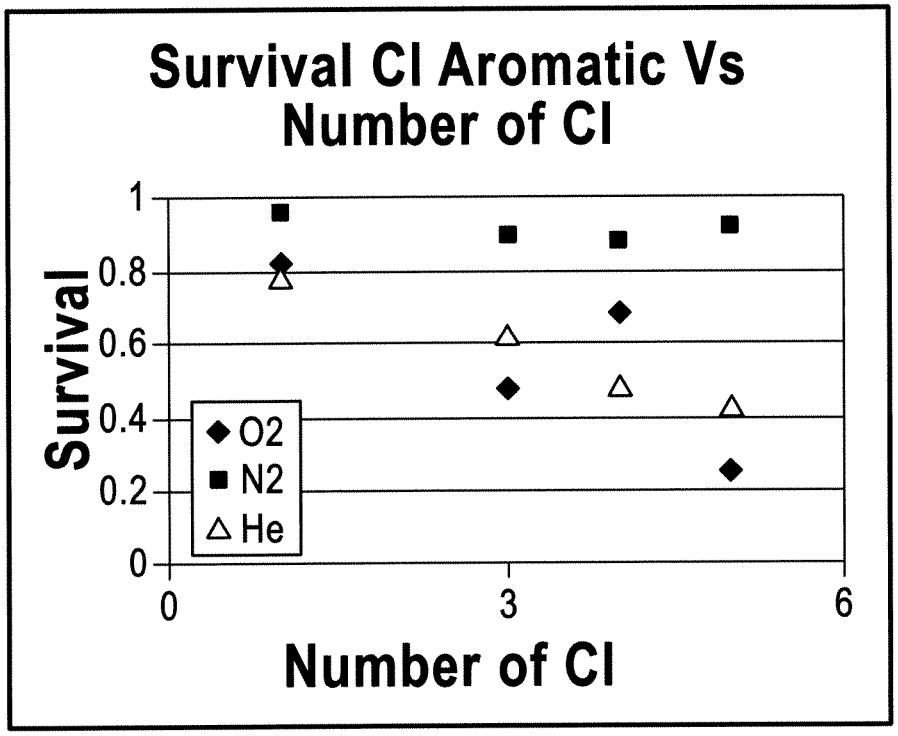
FIG. 11 provides a graphical representation of exemplary data showing the survival of molecular ions and ionization efficiency of Chlorine-containing aromatics within a soft glow discharge ion source when using various discharge gasses, such as Oxygen, Nitrogen and Helium.
Figure 11:
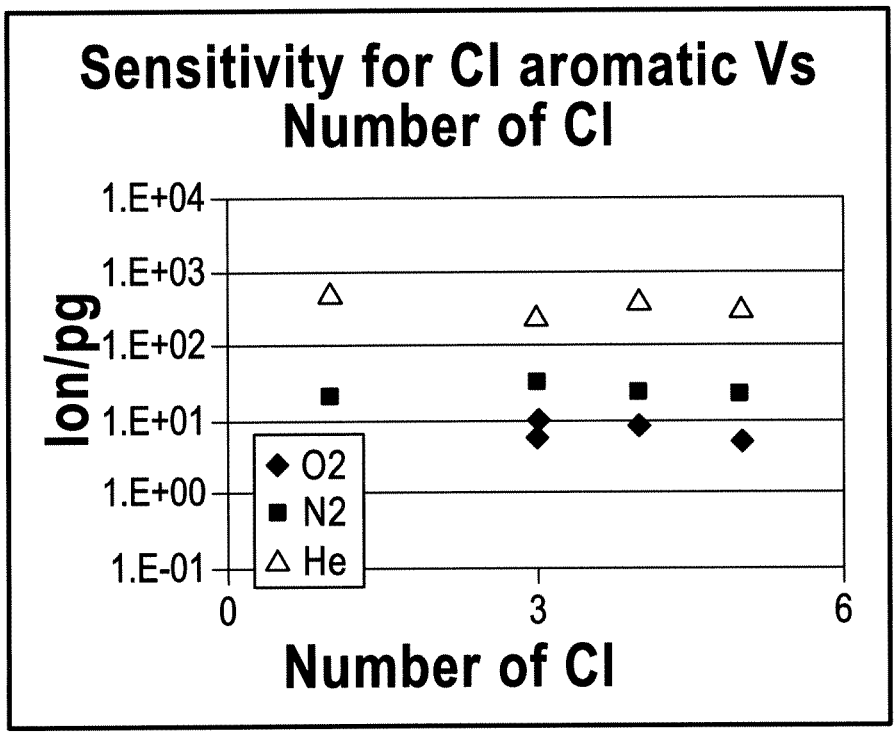

FIG. 11 illustrates the effect of a carrier gas in the soft GD method on sensitivity and survival of molecular ions of aromatics with a variable number of Chlorine atoms. A Helium discharge gas provides the highest sensitivity (300-500 ions/pg) but moderate softness. A Nitrogen carrier gas provides softer ionization but has lower sensitivity.

The mass spectrometer system 10, 100 with a soft ionizing glow discharge ion source 12, 12A, 102 may provide a range of new analytical opportunities by improving identification of volatile but fragile compounds which do not form reliably measurable molecular ions in the Electron Impact (EI) method. The method(s) of operating the mass spectrometer system 10, 100 can provide ionization of non-polar compounds and the gas chromatographic separation (e.g., GCxGC separation) is more powerful and more reproducible than liquid separation methods. Moreover, the method(s) of operating the mass spectrometer system 10, 100 may compliment molecular ion information by a set of smaller but well detectable fragments that match fragmentation patterns of the EI and CI methods. Strategies of identification can be based on the NIST library, library of in-silico generated fragments, and/or based on new libraries collected with soft GD ionization. The content and relative intensities of fragments is well reproducible in the soft GD source and is quite independent on the ionizer conditions as long as conditioning conditions eliminate excited particles and free electrons. Then the view of spectra depends on the chemistry of the analyte molecules in the process of charge exchange with reagent ions, preferably Helium ions.

The mass spectrometer system 10, 100 may provide flexibility in reagent ion selection and allow rapid switching between various reagent ions which can be simultaneously generated in at least two ionizers and delivered to the reactor by pneumatically switched flows from the ionizers. Identification strategies with alternated softness of ionization can be employed for better analysis of complex mixtures. Some compounds are better seen at selective ionization with APCI. Switching between ionization modes also improves the decision on whether observed ions are $M^+$, $MH^+$ or $(M-H)^+$.

In some implementations, the soft GD method provides a uniform ionization efficiency comparable to that provided by the EI method, and may thus be employed for quantitative analysis. The method also provides a low detection limit. For example, the signal for most organics reached 500-3000 ions per pg. While most of the intensity lies in molecular peaks, the detection limit approaches 0.01 pg.

The ionization method executable on the mass spectrometer system 10, 100 may provide soft, sensitive and uniform ionization for a wide range of volatile compounds—both polar and non polar. The method may be compatible with gas chromatography and with fast GCxGC, which allows identification of extremely complex mixtures in the wide dynamic range of concentrations. In some implementations, the ion source is compatible with multiple detection methods, such as current detection, ion mobility, and mass spectrometry. For example, the ion source can serve as a generic and sensitive GC detector, once helium ions are eliminated by an RF low cut off mass filter operating at a fore-vacuum gas pressure (e.g., pumped by a mechanical pump).

In some implementations, the ion mobility separation in combination with soft ionization may be particularly useful for detection of isomers, which may occur in GC-MS analysis. For example, there is a large variety of branched isomers in crude oil. The ion source is compatible for use with IMS at a mbar gas pressure range. Such separation employs ion trapping in RF traps prior to IMS separation and thus provides high sensitivity. The mobility separation can be complemented by subsequent mass spectrometric analysis for collecting full information.

Although mass spectrometric detection (via the mass spectrometer) can be the primary detection method for the ion source, other detection methods are possible. In some examples, the mass spectrometer, the for the sake of speed and sensitivity, is a fast recording time-of-flight mass spectrometer or a high resolution multi-reflecting mass spectrometer. Either mass spectrometer is capable of obtaining accurate mass information and recovering elemental composition for every observed peak in spectra. The recorded information can be used for distinguishing between analytes and chemical background and distinguishing between fragments and cluster ions. Since molecular peaks are dominant and fragments can be elementally linked to major parent ions, the mass spectrometer system may allow identification of multiple co-eluting components. When combining this capability with fast GCxGC or GC-IMS, the mass spectrometer system may allow analysis of extremely rich mixtures and/or reliably detecting ultra-traces on the top of rich matrices.

A number of implementations have been described. Nevertheless, it will be understood that various modifications may be made without departing from the spirit and scope of the disclosure. Accordingly, other implementations are within the scope of the following claims.

What is claimed is:

1. An ion source (12, 102) for a mass spectrometer comprising:

A glow discharge ionizer (18, 106) formatted to receive an ionizer gas from an ionizer gas supply (16);

a conditioner (20) in communication with the at least one ionizer (18, 106); and a reactor (22, 110) in communication with the conditioner (20) and formatted for communication with the mass spectrometer, the reactor (22, 110) formatted to receive a sample from a sample supply (24), wherein the conditioner (20) is sized to remove fast diffusing electrons from a flow of the ionizer gas between the glow discharge ionizer (18, 106) and the reactor (22, 110), wherein the conditioner (20) is sized to provide a transfer time of the gas flow from ionizer (18, 106) to the reactor (22, 110) of substantially at or between about 5 ms and about 10 ms, and wherein the conditioner (20)

comprises a tube having a length of substantially at or about 15 mm and an inner diameter of substantially at or about 2 mm.

2. The ion source (12, 102) of claim 1, wherein the conditioner (20) comprises a tube and a product of an inner diameter of the conditioner (20) and a pressure of the at least one ionizer (18, 106) is at least 50 mm*mbar.

3. The ion source (12, 102) of claim 1, wherein the ionizer (18, 106) comprises a glow discharge ionizer having an ionizer chamber (28) that houses an energized electrode (42) for providing ions of the supplied ionizer gas.

4. The ion source (12, 102) of claim 3, wherein a gas pressure of the ionizer chamber (28) of the glow discharge ionizer (18, 106) is at least about 30 mbar.

5. The ion source (12, 102) of claim 4, wherein a gas pressure of the ionizer chamber (28) of the glow discharge ionizer (18, 106) is maintained between about 30 mbar and about 300 mbar.

6. The ion source (12, 102) of claim 1, wherein the conditioner (20) is in communication with a dopant supplier (52) supplying a dopant agent to the conditioner (20).

7. The ion source (12, 102) of claim 1, wherein at least one of the reactor (22, 110) and the sample supplier (24) is in communication with a carrier gas supplier, the carrier gas supplier supplying a carrier gas for moving the sample from the sample supplier (24) to the reactor (22, 110).

8. The ion source (12, 102) of claim 1, wherein the reactor (22, 110) comprises a heater (113) for heating the reactor (22, 110) to at least 150° C.

9. The ion source (12, 102) of claim 1, further comprising a sampling channel (65, 118) pneumatically connecting the reactor (22, 110) to the mass spectrometer.

10. The ion source (12, 102) of claim 9, wherein the reactor (22, 110) and the sampling channel (65, 118) are sized to provide a residence time in the reactor (22, 110) of between about 5 ms and about 100 ms.

11. The ion source (12, 102) of claim 9, wherein the reactor (22, 110) defines a volume of about 200 $mm^3$.

12. The ion source (12, 102) of claim 9, wherein the sampling channel (65, 118) comprises a tube having an inner diameter of about 0.5 mm.

13. The ion source (12, 102) of claim 1, wherein the reactor (22, 110) is substantially free of electric fields for avoiding acceleration of residual free electrons.

14. The ion source (12, 102) of claim 1, wherein the ionizer (18, 106) comprises first and second ionizers (18, 72, 106, 108) in communication with the reactor (22, 110), the first ionizer (18, 106) receiving a first ionizer gas from a first ionizer gas supply (16) and the second ionizer (72, 108) receiving a second ionizer gas from a second ionizer gas supply (73), first and second conditioners connecting the respective first and second ionizers (18, 72, 106, 108) to the reactor (22, 110).

15. The ion source (12, 102) of claim 14, wherein the first ionizer (18, 106) comprises a glow discharge ionizer and the second ionizer (72, 108) comprises a photo-ionizer with a sealed ultraviolet lamp.

16. The ion source (12, 102) of claim 1, further comprising a source housing (104) enclosing the ionizer (18, 106), the conditioner (20), and the reactor (22, 110).

17. The ion source (12, 102) of claim 1, wherein the source housing (104) has a pressure of about 1 mbar.

* * * * *